US007224247B2

(12) United States Patent
Dean

(10) Patent No.: US 7,224,247 B2
(45) Date of Patent: May 29, 2007

(54) PHASE SHIFTER DEVICE HAVING A MICROSTRIP WAVEGUIDE AND SHORTING PATCH MOVABLE ALONG A SLOT LINE WAVEGUIDE

(75) Inventor: Michael Dean, Malvern (GB)

(73) Assignee: Qinetiq Limited (GB)

( * ) Notice: Subject to any disclaimer, the term of this patent is extended or adjusted under 35 U.S.C. 154(b) by 0 days.

(21) Appl. No.: 10/547,503

(22) PCT Filed: Mar. 8, 2004

(86) PCT No.: PCT/GB2004/001006

§ 371 (c)(1),
(2), (4) Date: Aug. 31, 2005

(87) PCT Pub. No.: WO2004/082063

PCT Pub. Date: Sep. 23, 2004

(65) Prior Publication Data

US 2006/0145784 A1 Jul. 6, 2006

(30) Foreign Application Priority Data

Mar. 12, 2003 (GB) ..... 0305619.9

(51) Int. Cl.
*H01P 1/18* (2006.01)

(52) U.S. Cl. ..... 333/161; 342/375

(58) Field of Classification Search ..... 333/161, 333/156, 159; 342/372, 375
See application file for complete search history.

(56) References Cited

U.S. PATENT DOCUMENTS

| | | | | |
|---|---|---|---|---|
| 2,961,622 | A | 11/1960 | Sommers | |
| 3,139,597 | A | 6/1964 | Jordan et al. | |
| 5,268,696 | A * | 12/1993 | Buck et al. | 342/372 |
| 6,091,311 | A | 7/2000 | Waters et al. | |
| 6,850,130 | B1 * | 2/2005 | Gottl et al. | 333/161 |
| 2002/0003458 | A1 | 1/2002 | Xu | |

FOREIGN PATENT DOCUMENTS

| | | |
|---|---|---|
| JP | 6 326502 | 11/1994 |
| JP | 6326501 | 11/1994 |

* cited by examiner

*Primary Examiner*—Benny Lee
(74) *Attorney, Agent, or Firm*—McDonnell Boehnen Hulbert & Berghoff LLP

(57) ABSTRACT

A phase shifter device comprising a substrate defining a slot line waveguide having first and second ends and being operably coupled to a microstrip waveguide and a shorting patch is described. The microstrip waveguide and shorting patch are moveable along the slot line waveguide so as to vary the distance between the first end of the slot line and the intersection of the slot line waveguide and microstrip waveguide whilst maintaining a substantially constant separation between the microstrip waveguide and the shorting patch. A separation between the microstrip waveguide and shorting patch equal to one quarter of the effective wavelength of the radiation carried by the device is described. The device is described for use in various phased array antenna systems.

20 Claims, 3 Drawing Sheets

PHASE SHIFTER DEVICE HAVING A MICROSTRIP WAVEGUIDE AND SHORTING PATCH MOVABLE ALONG A SLOT LINE WAVEGUIDE

BACKGROUND OF THE INVENTION (1) Field of the Invention

This invention relates to a phase shifter device for use at microwave or radio frequencies, and more particularly to phased array antenna apparatus incorporating a plurality of such phase shifter devices.

(2) Description of the Art

Phased array antennas are well known. In such devices the resultant radiation pattern transmitted (the transmit beam), or the radiation pattern received (the receive beam), is controlled by variation of the relative phase of the signal transmitted, or received, by each antenna element that forms the phased array. In this manner, it is possible to steer a transmit or receive beam electronically without any mechanical movement of the antenna.

The phase differences necessary for phased array operation can be introduced in a variety of ways. One of the simplest techniques is to link each antenna element to a common feed point using co-axial cables of different length. However, this fixes the relative phase shifts between the antenna elements which may be undesirable in certain applications where phase adjustment is required. It is also possible to obtain accurate phase control at very high speeds over multiple element phased array antenna using digital electronic phase shifting devices of the type used in phased array radar systems. Although such an approach is highly suited to radar applications, the complexity and cost of the electronic circuitry is prohibitively expensive for low cost, mass market, applications.

In cases where rapid phase control is not required, but providing a fixed relative phase difference is insufficient, low complexity adjustable phase shifters have been developed. Such phase shifters enable control, for example by an engineer setting up a system, over the directionality of phased array antennas having a relatively low number of elements. US2002/0003458 and JP6326501 describe such phase shifters.

In US2002/0003458 a phase shifter is described in which a dielectric element having a number of teeth is moveably mounted over a pattern of conductive tracks formed on a planar dielectric circuit board. Movement of the dielectric element alters the propagation velocity through the conductive track, thereby imparting the required phase shift. This enables a phase shift to be introduced between sets of transmitter elements (typically two or three) to enable a downward tilt of the transmit and receive beams of a cellular telephone base station transceiver. A drawback of the device of US2002/0003458 is that the linear movement of the moveable dielectric element does not provide a correspondingly linear change in the phase shift imparted to the signal as the effect of the dielectric element is difficult to predict. This can make it difficult to control the amount of phase shift imparted to a signal.

JP6326501 describes a variable phase shifter having a substrate that is provided with a pair of arc shaped slot lines of different radius. An output terminal is connected to each end of each slot line. A rotatable arm distributes input radiation to each of the arc shaped slot lines, and this radiation is further distributed to each of the four slot line output terminals. Rotation of the arm alters the relative path length between the input radiation and each of the four output terminals, thereby altering the phase of the radiation at each of the output terminal. A disadvantage of the device of JP6326501 is that it is only possible to operate the device as a combined signal splitter and phase shifter. Furthermore, independent control of the phase shift imparted to each of the four output signals is not possible; the geometry of the device dictates the phase shifts imparted to each of the four output signals for a given orientation of the rotatable arm.

SUMMARY OF THE INVENTION

According to a first aspect of the present invention, a phase shifter device comprises a substrate defining a slot line waveguide having first and second ends and being operably coupled to a microstrip waveguide and a shorting patch, the microstrip waveguide and shorting patch being moveable along the slot line waveguide so as to vary the distance between the first end of the slot line and the intersection of the slot line waveguide and microstrip waveguide whilst maintaining a substantially constant separation between the microstrip waveguide and the shorting patch.

The present invention thus provides a convenient way of producing an adjustable phase shifter that can operate with low losses and is relatively cheap and simple to fabricate. In particular the provision of a moveable shorting patch in association with the micro-strip waveguide provides a transition that maximises transmission of radiation between the slot line and microstrip waveguides. This arrangement allows a controllable phase shift to be imparted to all the power contained in a signal, and is thus not restricted to the multiple way signal splitting phase shifter described in JP6326501. Furthermore, the requirement for a long length of meandering track as described in US2002/0003458 is removed.

A device of the present invention could operate with Radio Frequency (RF) or microwave radiation. For example, radiation in the range 1 GHz to 100 GHz could be used. In particular, the device could be used for Direct Broadcast Satellite (DBS) applications that use radiation around 12 GHz, Wireless Local Area Networks (WLAN) operating in the 2–5 GHz band or Very Small Aperture Terminals (VSAT) systems operating around 17 GHz. It would be appreciated that different wavelengths of radiation will require the physical dimensions of the device to be selected accordingly. The size of the device will depend on the material of the substrate (i.e. the wavelength within the slot line waveguide) and the amount of phase shift that is to be applied to the signal(s).

Preferably, the substantially constant separation of the microstrip waveguide and shorting patch is substantially equal to one quarter of the effective wavelength of the radiation carried by the device.

Herein, the term "effective wavelength" means the wavelength of the radiation within the slot line waveguide; i.e. the free space wavelength divided by the square root of the effective relative permittivity of the structure defining the slot line waveguide. Selecting the separation between the shorting patch and the microstrip to be around one quarter of the effective wavelength of the radiation carried by the device ensures the maximum coupling efficiency of radiation at the intersection between the slot line and microstrip waveguide. In this context, the skilled person would recognize that "substantially" equal to one quarter of the effective wavelength of the radiation carried by the device means that the separation should be within 50% or more preferably 25% or even more preferably 10% of the optimum quarter wavelength distance.

Provision of a moveable first arm portion moveably mounted to the substrate provides a convenient means of carrying the microstrip waveguide. Furthermore, an arm portion formed from a dielectric material is advantageous, especially when the dielectric material is located between the substrate and the microstrip waveguide. This ensure a constant spacing of the slot line and microstrip waveguides.

Advantageously, the shorting patch is carried on a second arm portion that is moveably mounted to the substrate. Forming the arm portion from dielectric material is preferable, especially when the layer of dielectric material is located between the shorting patch and the substrate. This arrangement prevents metal to metal contact between the shorting patch and the slot line waveguide thereby reducing the level of noise typically associated with intermittent metal to metal contacts.

Rotatably mounting the first and/or second arm portions to the substrate is a convenient way of providing the necessary moveable motion. Preferably, the first and second arm portions are mounted to the substrate about a single pivot point and the first arm portion is located on a first side of the substrate and the second arm portion is located on a second side of the substrate. In this manner, rotation of the two arm portions causes movement of the microstrip waveguide and shorting patch in unison along the slot line waveguide.

Conveniently the slot line waveguide is formed as an arc of substantially constant radius. Hence, when the pivot point is located at the centre point of the arc, rotation of the first and second arm portions causes a linear change in the separation between the first end of the slot line waveguide and the intersection of the slot line waveguide and microstrip waveguide.

Alternatively, the slot line could have a spiral shape. Herein, the term "spiral" is taken to mean that the slot line is not located a constant radial distance from the pivot point. The use of a spiral, rather than a circular, slot line alters the phase shift imparted for a given rotation. In other words, the change in path length has no linear correspondence to the amount of rotation of the arm portions in relation to the substrate. The exact shape of the spiral slot line can be selected so as to impart the desired phase shift profile for a linear rotation of the arm portions. A particularly useful configuration, especially in the field of phase array radar, is the provision of a slot line in which the phase imparted by the device varies sinusoidally with the angle of rotation of the arm portions.

Advantageously, a mechanical rotation means, such as an electric motor, is provided to rotate the first arm portion and the second arm portion. Alternatively or additionally, the first and second arm portions can be rotated by hand.

Conveniently, the shorting patch comprises a layer of metal which is preferably copper.

Preferably, the substrate comprises a layer of dielectric material and/or a layer of metal. The slot line waveguide may advantageously be formed by a layer of copper printed on to a dielectric substrate. The use of metal printing techniques (especially those utilizing copper metal) provide broad band waveguides at a low cost. Such techniques are highly suited to the fabrication of devices of the present invention.

Conveniently, an additional microstrip waveguide is formed on the substrate and operably coupled to the first end of the slot line waveguide. The additional microstrip waveguide may be formed on the opposite side of the substrate to the slot line waveguide and operably coupled thereto by a known transition; for example the ends of the additional microstrip waveguide and the slot line may be arranged to overlap each other by a distance of around one quarter of a wavelength. Alternatively a shorting pin could be used to provide a conductive path between the slot line and microstrip waveguides. The additional microstrip provides a way of coupling radiation from, or into, the slot line waveguide.

Phase control means may also be advantageously provided to control movement of the microstrip waveguide and shorting patch thereby controlling the phase shift imparted by the device. For example, the phase control means could implement a feed-back control loop to maintain signal reception of a certain quality.

According to a second aspect of the invention, a phase shifting array comprises a plurality of devices according to a first aspect of the invention. Building up such an array of phase shifters allows independently controllable phase shifts to be applied to the antenna elements of a phased array.

According to third aspect of the invention, phased array antenna apparatus comprises a phase shifting array according to the second aspect of the invention.

According to a fourth aspect of the invention, a phase shifting device comprises a substrate comprising a slot-line waveguide interfaced to a first radiation feed point, a first arm portion comprising a microstrip waveguide interfaced to a second radiation feed point and additionally arranged to intersect said slot-line waveguide at a first slot-line intersection point, and a second arm portion carrying a shorting patch arranged to short said slot-line at a second point of slot-line intersection, the first point of slot-line intersection being located on the slot-line waveguide between the first radiation feed point and the second point of slot-line intersection, and the second point of slot-line intersection being separated from the first point of slot-line intersection by a distance of slot-line waveguide substantially equal to one quarter of a wavelength of the radiation carried by the device, wherein the first and second arm portions are moveably mounted with respect to the substrate such that the location of the first and second points of slot-line intersection can be varied, whilst maintaining a substantially constant relative separation between the first and second points of slot-line intersection, thereby altering the path length between the first radiation feed point and the second radiation feed point.

DESCRIPTION OF THE FIGURES

The invention will now be described, by way of example only, with reference to the following figures in which.

DESCRIPTION OF THE PREFERRED EMBODIMENT

Figure 1:
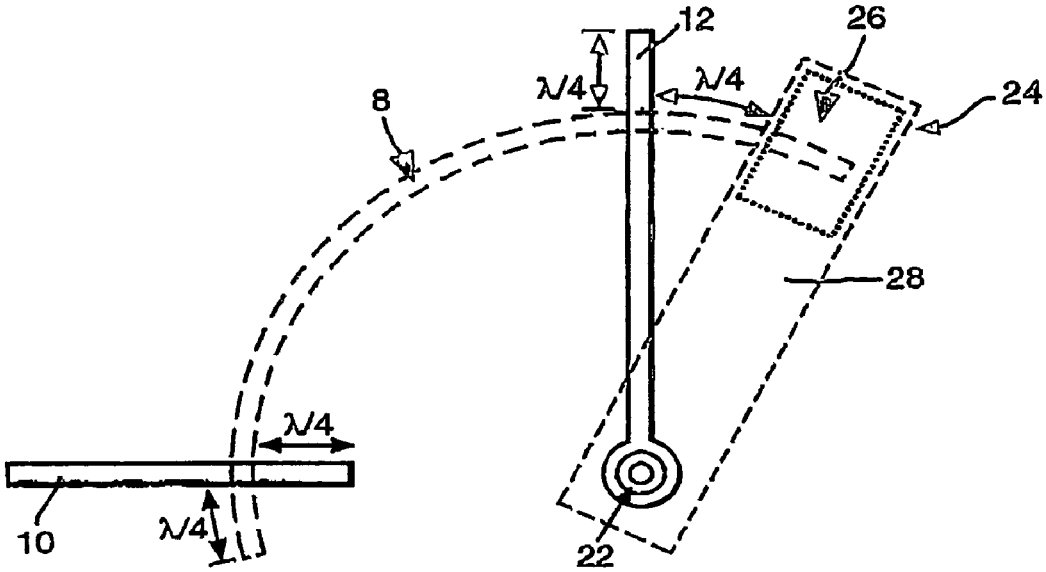
FIG. 1 show a plan view of a phase shifter of the present invention.
Figure 2:
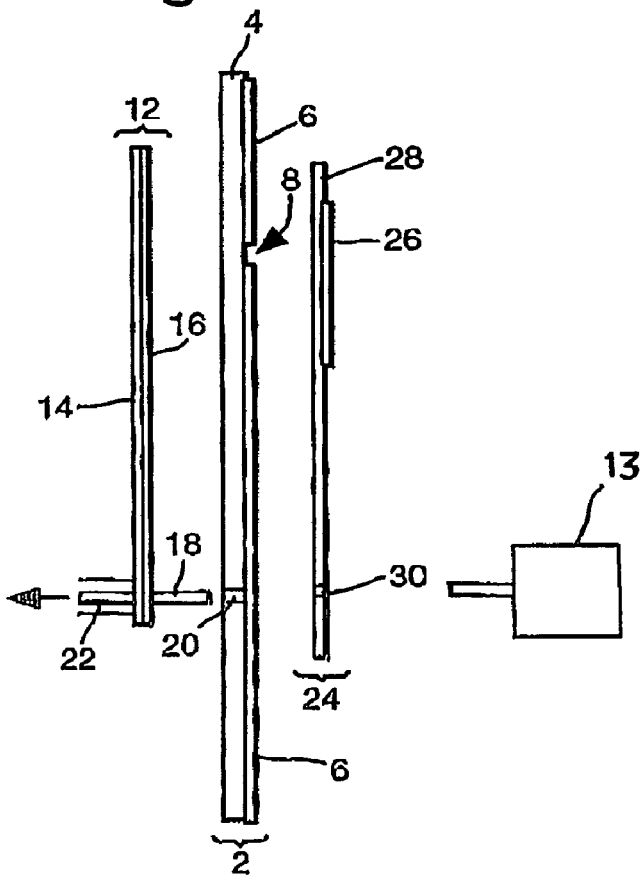
FIG. 2 provides an exploded side view of the three elements forming the phase shifter shown in FIG. 1.

Referring to FIGS. 1 and 2, a schematic illustration of a phase shifter of the present invention is shown. The phase shifter comprises a substrate 2 formed from a dielectric layer 4 having a printed metal layer 6 (shown in FIG. 2) located on a first surface of thereof. A truncated circular slot line waveguide 8 is formed in the metal layer 6. An output microstrip waveguide 10 (not shown in FIG. 2) is provided at a first end of the slot line waveguide 8 on the second surface of the dielectric layer 4. A known micro-strip to slot line transition is provided to couple radiation to the input microstrip waveguide 10 from the slot line waveguide 8; the transition may comprise an microstrip to slot line interface or a shorting pin. The transition involves waveguides 8 and 10 crossing over each other with an overlap of distance $\lambda/4$.

A first arm portion 12 is provided and comprises a microstrip waveguide 14 mounted on a thin layer of dielectric material 16 shown in FIG. 2. The layer of dielectric material is located between the microstrip waveguide 14 and the substrate 2. The first arm portion 12 comprises a protrusion 18 to enable its proximal end to be pivotally mounted to a corresponding slot 20 in the substrate 2 shown in FIG. 2. The pivot mounting also comprises a-pin 22 coupled to the microstrip waveguide 14 to allow the waveguide 14 to be coupled to an external waveguide input, such as a co-axial cable (not shown). The distal end of the microstrip waveguide 14 carried by the first arm portion is arranged to radially extend a distance of one quarter of a wavelength past the slot line.

Referring to FIG. 2, a second arm portion 24 is also provided and is located on the opposite side of the substrate than the first arm portion 12. The second arm portion 24 comprises a shorting patch 26 mounted on a layer of dielectric material 28. The layer of dielectric material 28 is located between the shorting patch 26 and the substrate 2. Arm portion 24 is located with respect to arm portion 12 such that there is a $\lambda/4$ separation of the two along waveguide 8. Also, arm portion 12 extends beyond waveguide 8 for a distance of $\lambda/4$, to form a waveguide. The second arm portion further 24 comprises a recess 30 at its proximal end for connection with the corresponding protrusion 18 of the first arm portion. In this way, the second arm portion 24 is also pivotally mounted to the substrate 2 about the same pivot point as the first arm portion.

Although discrete first and second arm portions located on different sides of the substrate are described, it should be noted that the phase shifting device could also be implemented using a second arm portion located on the same side of the substrate as the first arm portion. This would also allow integral first and second arm portions to be provided. In such a configuration, the dielectric layer 4 of the substrate should be sufficiently thin for the shorting patch 26 to efficiently short the slot line thereby maximising the coupling efficiency between the slot line waveguide and the microstrip waveguide 14.

The microstrips 10 and 14, printed metal layer 6 and shorting patch 26 are formed from copper that is printed on to the layers of dielectric material using printing techniques known to those skilled in the art. Although copper metal is convenient for low cost devices, any conductive material (e.g. other metals such as gold or silver) could be used instead.

The dielectric material of the various portions of a device of the present invention may comprise any one of a number of dielectric materials known to those skilled in the art. Preferably the relative permittivity of such materials is greater than two and less than ten. For example, polyester ($\in_r \approx 2$), fiber glass weave ($\in_r \approx 4$) or alumina ($\in_r \approx 10$) may be used.

In use, a RF signal is fed to the microstrip waveguide 14 of the first arm portion via the pin 22. The microstrip waveguide 14 of the first arm portion is arranged to intersect the slot line waveguide 8 and transmits radiation thereto. Radiation carried by the slot line waveguide 8 is then output from the device via the output microstrip waveguide 10. Rotation of the first arm portion causes movement of the point of intersection of the microstrip waveguide 14 and the slot line waveguide 8 thereby altering the patch length of radiation through the device. It is this change in path length that provides the required phase shift. It should be noted that the device would also operate in reverse; i.e. the pin 22 of the first arm portion could act as an output, and the radiation could be fed into the device via the micro-strip waveguide 10.

To ensure optimum coupling efficiency between the microstrip waveguide 14 and the slot line waveguide 8, the separation between the shorting patch 26 and the microstrip waveguide 14 is arranged to be around one quarter of the wavelength of the radiation. Shorting the slot line at this distance from the microstrip maximizes the efficiency of the slot line to microstrip transition. Furthermore, the shorting patch 26 of the second arm portion 24 is arranged to move in a coupled manner with the first arm portion 12; i.e. the separation between the shorting patch 26 and the microstrip waveguide 14 is kept constant as the first and second arm portions are rotated.

In this manner, rotation of the first and second arm portions with respect to the substrate provides a moveable microstrip to slot line transition. The transition has a high coupling efficiency such that losses in the device are minimal. Furthermore, as there are no metal to metal contacts (i.e. the metal portions are separated by layers of dielectric material) the noise typically associated with such contacts is avoided. Phase shifters of, the present invention thus provide broad band operation with low levels of signal loss and are inexpensive to fabricate. The use of rotary arm portions also provides a simple means of altering the phase by imparting a rotary motion by hand or using a rotary drive means such as an electric motor 13.

The provision of such a low loss transition is especially useful as it will provide uniform phase control of all the power contained in a signal. This should be contrasted to devices of the type described in JP6326501 in which a single rotating arm serves to distribute power between two or more signal output connections. Devices of the type descried in JP6326501 are incapable of phase shifting an entire signal; the phase shifts imparted to each of the output signals split from a single input signal are inherently complementary.

The device is also more controllable, and potentially significantly physically smaller, than the devices described in US2002/0003458. The device of US2002/0003458 operates by moving a dielectric material into the vicinity of a long length of meandering track through which the signal is propagating. The introduction of the saw tooth layer of dielectric material serves to alter the effective permittivity of the track, thereby imparting a phase shift. This is in contrast to the present invention in which the path length is physically altered by movement of the slot line to microstrip transition. Controlling the path length in accordance with the present invention provides a more predictable and reliable method of imparting a specified phase shift; i.e. the phase shift due a certain change in path length is easier to predict than the effect of introducing a dielectric material into the vicinity of a track. Furthermore, to obtain a useful phase shift in a device of the type described in US2002/0003458 requires a long track. Although a meandering track is described in US2002/0003458, a shorter track length is required in a device of the present invention thereby reducing the overall size and fabrication cost.

Figure 3:
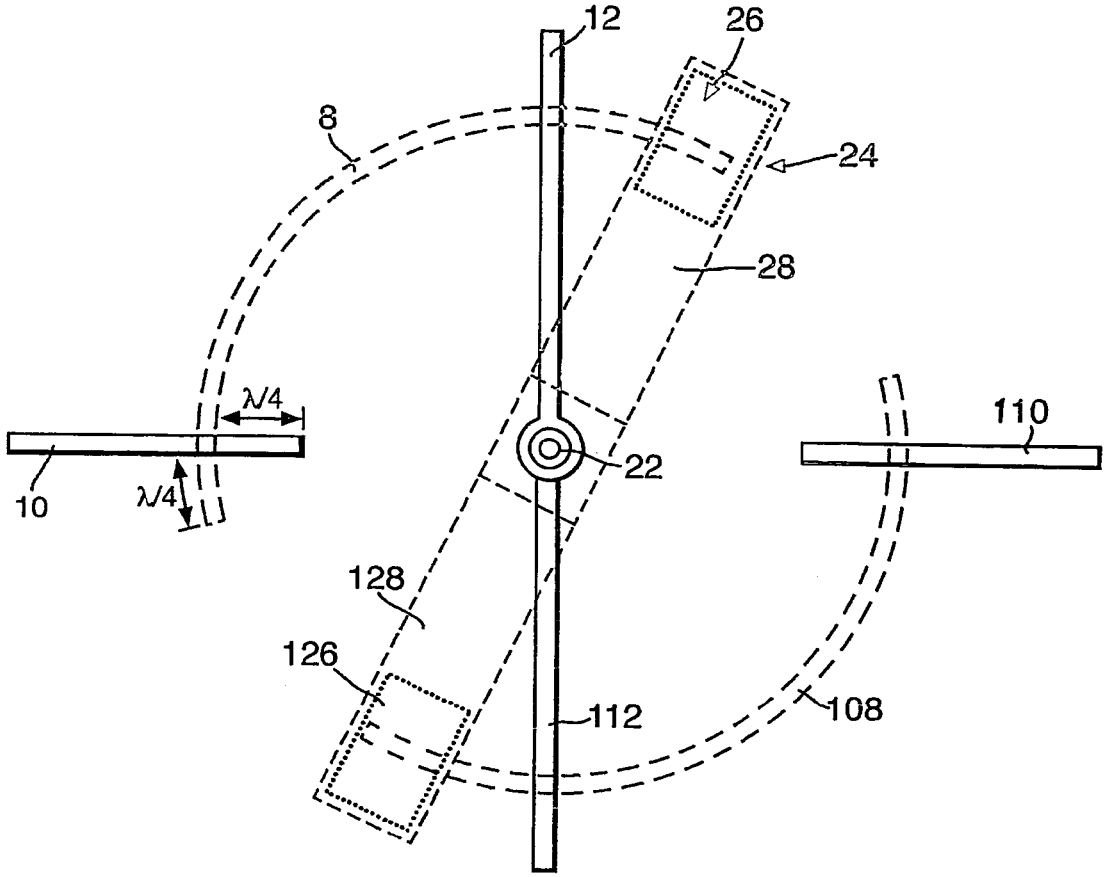
FIG. 3 show a phase shifter according to the present invention arranged to provide two output signals.

Referring to FIG. 3, a variation on the device described with reference to FIGS. 1 and 2 is shown with features common thereto being identified with similar reference numerals. Note the device shown in FIGS. 3 and 4 use substrates similar to substrate 2 having a metal layer 6 as shown in FIG. 2.

The device shown in FIG. 3, in common with the device described with reference to FIG. 1, comprises a slot line waveguide 8 formed in a metal layer that is located on the first surface of substrate. A first arm portion 12 and a second arm portion 24 are also provided. The device additionally comprises a second slot line waveguide 108 formed in the metal layer 6 of the substrate, and a second microstrip output waveguide 110.

In addition to the first arm portion 12, a third arm portion 112 of a similar construction to the first arm portion 12 is provided. The third arm portion 112 comprises a microstrip waveguide (not shown) that is also coupled to the pin 22. A fourth arm portion 128, of a similar construction to the second arm portion 28 and carrying a second shorting patch 126, is also provided. The shorting patches of the second and fourth arm portions are arranged to short the associated slot line waveguides (i.e. slot line waveguide 8 for patch 26, and slot line 108 for shorting patch 126) at a distance of around one quarter of the wavelength of the radiation on which the device acts. The first, second, third and fourth arm portions are pivotally mounted to the substrate by their proximal ends and are arranged to rotate together about a common pivot point defined by the pin 22.

In use, the device splits radiation received via the pin 22 between the microstrip waveguides of the first arm portion 12 and the third arm portion 112. The ratio of the radiation split may be controlled as desired. The radiation in each of the microstrip waveguides of the arm portions is then coupled into the slot line waveguides 8 and 108 respectively. Rotation of the four arm portions alters the point of intersection of the first arm portion 12 with the slot line 8 and also the point of intersection of the third arm portion 112 with the slot line 108. The shorting patches carried by the second and fourth arm portions are arranged to in a coupled manner with the first and second arm portions thereby ensuring efficient coupling of radiation into the respective micro strip. In this manner, phase shifts are imparted to the signals output by the output microstrip 10 and the 110.

The phase shifts imparted to the split signals can be arranged to be substantially the same, or a certain phase offset between the two output signals can be provided. Although the four arm portions may all rotate in unison as described above, it is also possible for the device to be arranged such that the first and second arms portions rotate independently of the third and fourth arm portions; this provides truly independent control of the phase shift applied to each of the two output signals. It can thus be seen that a device of the present invention provides greater phase control flexibility than the prior art device described above.

It should be appreciated that it would be apparent to the skilled person how various alternative designs in accordance with the present invention could be implement. For example, a plurality of concentric slot lines could be provided in conjunction with arm portions having two shorting patches; one shorting patch for each slot line. Also, if two or more slot lines are provided one could be located on a different side of the substrate to the other with the associated arm portions reversed in located with respect to the substrate accordingly. Furthermore, the position of the input microstrips 10, 110 could be varied to provide different path lengths thereby providing a phase offset.

Figure 4:
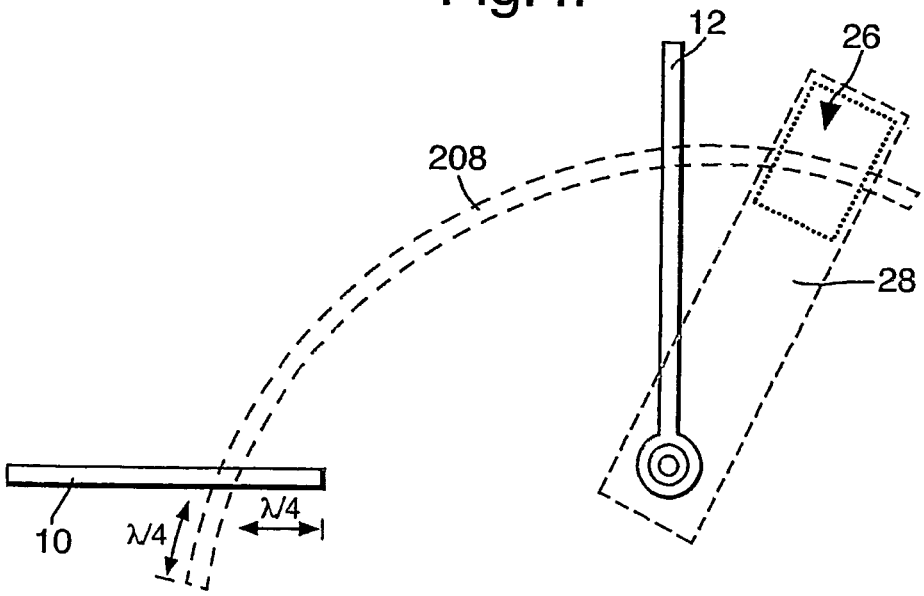
FIG. 4 shows a phase shifter according to the present invention having a spiral slot line waveguide formed therein.

Referring to FIG. 4, a further phase shifter of the present invention is shown with elements that are similar to those shown in FIGS. 1 and 2 being assigned like reference numeral. The phase shifter comprises a first arm portion 12 and a second arm portion 26 arranged about a substrate in the same configuration described with reference to FIGS. 1 and 2 above. However, a spiral slot line 208 is formed in a metal layer carried by the substrate. The term "spiral" is taken herein to mean that the slot line is not located a constant radial distance from the pivot point.

The use of a spiral, rather than a circular, slot line alters the phase shift imparted for a given rotation. In other words, the change in path length no longer has a linear correspondence to the amount of rotation of the arm portions in relation to the substrate. The exact shape of the spiral slot line can thus be selected so as to impart the desired phase shift profile for a linear rotation of the arm portions. A particularly useful configuration, especially in the field of phase array radar, is the provision of a slot line in which the phase imparted by the device varies sinusoidally with the angle of rotation of the arm portions.

Numerous alternative slot line configurations could be readily designed by the skilled person to implement numerous phase variation characteristic. In this manner, it can be seen that a device of the present invention is more flexible and provides enhanced phase control compared with the prior art phase shifting devices described above.

It should be noted that although devices of the present invention are described above with dielectric layers, a phase shifter could also be fabricated using metal portions separated by air gaps. In other words, air (having Er=1) could be used as the dielectric material to separate the metal components. A person skilled in the art would recognize the benefits of such an arrangement; for example the reduced manufacturing costs associated with fabricating metal based (e. g. tin plated steel) components.

Figure 5:
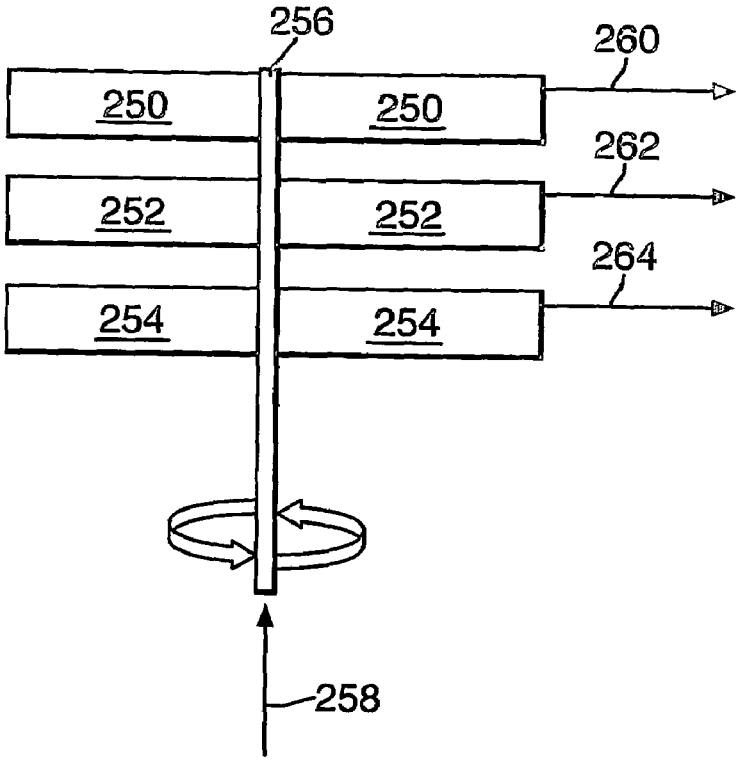
FIG. 5 shows a stack of three phase shifters according to the present invention.

Referring to FIG. 5, an array of phase shifters of the type described with reference to FIGS. 1 and 2 above is shown. A first phase shifter 250, a second phase shifter 252 and a third phase shifter 254 are arranged about a common shaft 256. The common shaft 256 is mechanically coupled to the first and second arm portions of each of the first, second and third phase shifters and also acts to couple the input pins of the three phase shifters to a common radiation input line 258.

In use, radiation provided to each of the phase shifters is output, after the application of any phase shift by the associated phase-shifter, via the output lines 260, 262 and 264. Rotation of the common shaft 256 alters the phase shift applied by each of the phase shifters. Although rotation of the shaft 256 causes the same amount of arm rotation in each phase shifter, the phase shift applied to each output signal is not necessarily identical. For example, the offset of each phase shifter could be selected prior to linking the phase shifter to the shaft.

Furthermore, the design of each phase shifter could be different such that a certain shaft rotation provides a different change in the phase applied by each phase shifter. For example, the radii of the slot lines could be different in each phase shifting device. Alternatively, spiral slot lines could be provided in each phase shifter to provide the desired phase change in response to arm portion rotation.

The shaft 256 could be rotated by hand, or a mechanical rotation means such as an electric motor could be used to provide the necessary rotation. The mechanical rotation means may also provide another function; for example it may also be used to also mechanically rotate a phased array antenna. The mechanical rotation means could be controlled by a processor (e.g. a computer) to provide the required phase shifts in response to certain pre-programmed criteria or in a feed-back control loop. For example, a feed back control loop could constantly vary phase shifts to maximise the quality or strength of received signals or alternatively periodic checks of signal quality (e.g. every 5–10 minutes) could be performed and adjustments made as appropriate Although the array shown in FIG. 5 shows common rotation control, it should be noted that separate rotation means could be provided for each phase shifter. This would provide truly independent phase control adjustment means for each phase shifter in the array. Such independent phase control is particularly advantageous to compensate for inter-element coupling effects that can produce unwanted side lobes in the receive or transmit beams.

Figure 6:
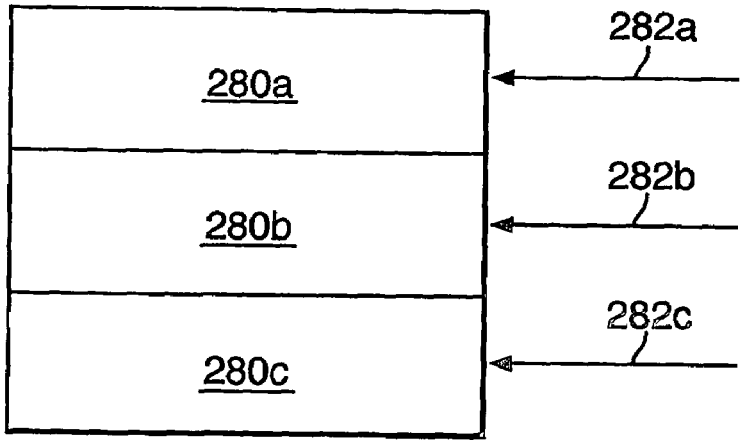
FIG. 6 shows a three element phased array antenna incorporation phase shifters of the present invention.

Referring to FIG. 6, a three element phased array antenna is shown. The antenna comprises three transceiver antenna elements 280*a*, 280*b*, 280*c*, and associated lines 282*a*, 282*b*, 282*c* to feed said transceiver antenna elements. A phase shifter array of the type described in FIG. 5 may be used to feed three of the transceiver antenna elements.

Application of appropriate phase shifts by the phase shifter array enable upward or downwards tilts of the transmit and/or receive beams.

The phase shifter may be provided in a separate package, or may be integrally mounted within the antenna panel. The phased array antenna may be used, for example, in a wireless local area network (WLAN) or as a digital broadcast system (DBS) receiver. Typically, such communication systems operate around the 12 GHz region.

Although rotatable phase shifting devices are described above and provide a convenient means of movement, the device could be arranged differently. For example, it could comprise a sliding or tracked mechanism.

The invention claimed is:

1. A phase shifter device comprising a substrate defining a slot line waveguide having first and second ends and being operably coupled to a microstrip waveguide and a shorting patch, the microstrip waveguide and shorting patch each being moveable along the slot line waveguide so as to vary the distance between the first end of the slot line and the intersection of the slot line waveguide and microstrip waveguide while maintaining a substantially constant separation between the microstrip waveguide and the shorting patch.

2. A device according to claim 1 wherein the substantially constant separation of the microstrip waveguide and shorting patch is substantially equal to one quarter of the effective wavelength of the radiation carried by the device.

3. A device according to claim 1 wherein a first arm portion carries the microstrip waveguide and said first arm portion is moveably mounted to the substrate.

4. A device according to claim 3 wherein the first arm portion comprises a layer of dielectric material on which the microstrip waveguide is carried.

5. A device according to claim 4 wherein the layer of dielectric material is located between the substrate and the microstrip waveguide.

6. A device according to claim 3 wherein the shorting patch is carried on a second arm portion that is moveably mounted to the substrate and said first arm portion and said second arm portion are rotateably mounted to the substrate.

7. A device according to claim 6 wherein an electric motor is provided to rotate the first arm portion and the second arm portion.

8. A device according to claim 6 wherein the slot line waveguide is formed as at least one of an arc of substantially constant radius and a spiral.

9. A device according to claim 6 wherein the substrate has a first side and a second side, wherein the first arm portion is located on the first side of the substrate and the second arm portion is located on the second side of the substrate.

10. A device according to claim 6 wherein said first arm portion and said second arm portion are mounted to the substrate about a single pivot point.

11. A device according to claim 1 wherein an additional microstrip waveguide is formed on the substrate and operably coupled to the first end of the slot line waveguide.

12. A device according to claim 1 wherein a phase controller is provided to control movement of the microstrip waveguide and shorting patch thereby controlling the phase shift imparted by the device.

13. A phase shifting array comprising a plurality of devices according to claim 1.

14. Phased array antenna apparatus comprising a phase shifting array according to claim 13.

15. A device according to claim 1 wherein the slot line waveguide is formed by a layer of copper printed on to the dielectric substrate.

16. A device according to claim 1 wherein the shorting patch comprises a layer of metal.

17. A device according to claim 1 wherein the substrate comprises at least one of a layer of dielectric material and a layer of metal.

18. A device according to claim 1 wherein the shorting patch is carried on a second arm portion that is moveably mounted to the substrate.

19. A device according to claim 18 wherein the second arm portion carrying the shorting patch comprises a layer of dielectric material located between the shorting patch and the substrate.

20. A phase shifting device comprising;

a substrate comprising a slot-line waveguide interfaced to a first radiation feed point, a first arm portion comprising a microstrip waveguide interfaced to a second radiation feed point and additionally arranged to intersect said slot-line waveguide at a first slot-line intersection point, and a second arm portion carrying a shorting patch arranged to short circuit said slot-line at a second point of slot-line intersection, the first point of slot-line intersection being located on the slot-line waveguide between the first radiation feed point and the second point of slot-line intersection, and the second point of slot-line intersection being separated from the first point of slot-line intersection by a distance of slot-line waveguide substantially equal to one quarter of a wavelength of the radiation carried by the device, wherein the first and second arm portions are moveably mounted with respect to the substrate such that the location of the first and second points of slot-line intersection can be varied, while maintaining a substantially constant relative separation between the first and second points of slot-line intersection, thereby altering the path length between the first radiation feed point and the second radiation feed point.

* * * * *